US010436185B2

(12) United States Patent
Conti

(10) Patent No.: US 10,436,185 B2
(45) Date of Patent: Oct. 8, 2019

(54) FUEL UNIT PUMP AND INTERNAL COMBUSTION ENGINE INCLUDING A FUEL UNIT PUMP

(71) Applicant: GM GLOBAL TECHNOLOGY OPERATIONS LLC, Detroit, MI (US)

(72) Inventor: Antonino Conti, Turin (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 408 days.

(21) Appl. No.: 15/266,409

(22) Filed: Sep. 15, 2016

(65) Prior Publication Data

US 2017/0074253 A1 Mar. 16, 2017

(30) Foreign Application Priority Data

Sep. 15, 2015 (GB) ..... 1516293.6

(51) Int. Cl.

| | |
|---|---|
| ***F04B 9/04*** | (2006.01) |
| ***F02M 39/02*** | (2006.01) |
| ***F02M 59/02*** | (2006.01) |
| ***F02M 59/44*** | (2006.01) |
| ***F04B 17/05*** | (2006.01) |
| ***F04B 19/22*** | (2006.01) |
| ***F04B 1/04*** | (2006.01) |
| ***F02M 59/10*** | (2006.01) |

(52) U.S. Cl.

CPC ..... *F04B 9/042* (2013.01); *F02M 39/02* (2013.01); *F02M 59/02* (2013.01); *F02M 59/027* (2013.01); *F02M 59/102* (2013.01); *F02M 59/445* (2013.01); *F04B 1/0413* (2013.01); *F04B 17/05* (2013.01); *F04B 19/22* (2013.01); *F02M 2200/9053* (2013.01)

(58) Field of Classification Search

CPC ..... F02M 39/02; F02M 59/02; F02M 59/027; F02M 59/102; F02M 59/445; F04B 9/042

USPC ..... 92/142

See application file for complete search history.

(56) References Cited

U.S. PATENT DOCUMENTS 5,931,133 A * 8/1999 Giannone ..... F01L 1/14 123/90.42

6,776,143 B2 * 8/2004 Goodenough ..... F02M 57/023 123/446

(Continued)

FOREIGN PATENT DOCUMENTS

| | | |
|---|---|---|
| DE | 102009001314 A1 | 9/2010 |
| DE | 102011084850 A1 | 4/2013 |
| WO | 2012013452 A1 | 2/2012 |

OTHER PUBLICATIONS

Great Britain Patent Office, Great Britain Search Report for Great Britain Application No. 1516293.6, dated Mar. 11, 2016.

*Primary Examiner* — Nathaniel E Wiehe
*Assistant Examiner* — Richard C Drake
(74) *Attorney, Agent, or Firm* — Lorenz & Kopf, LLP

(57) ABSTRACT

A fuel unit pump for an internal combustion engine includes a fuel unit pump body, a pumping plunger and a roller tappet for contacting a cam lobe of a rotatable shaft of the internal combustion engine. The roller tappet includes a roller tappet body connected to the pumping plunger, and a cam roller rotatably mounted on a cam roller carrier and defining a cam roller rotation axis. The cam roller carrier is coupled to the roller tappet body and is elastically deformable for aligning the cam roller with the cam lobe.

11 Claims, 4 Drawing Sheets

(56) References Cited

U.S. PATENT DOCUMENTS

| | | | | |
|---|---|---|---|---|
| 7,793,583 | B2 * | 9/2010 | Radinger | F01L 1/143 74/569 |
| 8,235,018 | B2 * | 8/2012 | Dorn | F01L 1/14 123/90.48 |
| 9,885,330 | B1 * | 2/2018 | Xu | F02M 59/102 |
| 10,047,641 | B2 * | 8/2018 | Oka | F02M 59/10 |
| 2011/0088506 | A1 * | 4/2011 | Oishi | F01L 1/143 74/569 |
| 2012/0234277 | A1 * | 9/2012 | Dorn | F01L 1/146 123/90.48 |
| 2012/0294741 | A1 * | 11/2012 | Nishimura | F02M 59/102 417/437 |
| 2013/0340695 | A1 * | 12/2013 | Fujii | F01L 1/14 123/90.48 |
| 2014/0033858 | A1 * | 2/2014 | Park | F16H 53/06 74/569 |
| 2015/0059520 | A1 * | 3/2015 | Chambonneau | F16H 25/14 74/569 |
| 2015/0082938 | A1 * | 3/2015 | Schick | F01L 1/14 74/569 |
| 2015/0090209 | A1 * | 4/2015 | Berruet | F04B 1/0439 123/90.26 |
| 2015/0361835 | A1 * | 12/2015 | Berruet | F01L 1/14 74/569 |
| 2016/0160986 | A1 * | 6/2016 | Berruet | F02M 59/102 74/569 |
| 2016/0245248 | A1 * | 8/2016 | Ando | F02M 59/102 |
| 2016/0273532 | A1 * | 9/2016 | Sassnick | F04B 1/0448 |

* cited by examiner

FUEL UNIT PUMP AND INTERNAL COMBUSTION ENGINE INCLUDING A FUEL UNIT PUMP

CROSS-REFERENCE TO RELATED APPLICATION

This application claims priority to Great Britain Patent Application No. 1516293.6, filed Sep. 15, 2015, which is incorporated herein by reference in its entirety.

TECHNICAL FIELD

The present disclosure pertains to the fuel injection of an internal combustion engine, and in particular to a fuel unit pump of an internal combustion engine.

BACKGROUND

In one configuration, an internal combustion engine injection system includes a fuel unit pump configured to supply fuel under pressure to the fuel injectors or injector nozzle. The fuel unit pump is actuated by a correspondent cam lobe of a rotating shaft of the internal combustion engine, e.g. the camshaft or crankshaft. In particular, the fuel unit pump is provided with a roller tappet that is contacted by the camshaft, in a cam—cam follower configuration. The cam lobe of the camshaft acts as the cam and the roller tappet acts as the cam follower. The roller tappet is connected to a pumping plunger so that the rotary movement of the camshaft can be transmitted to the fuel unit pump, and in particular to the pumping plunger of the fuel unit pump actuated by the contact of the roller tappet with the cam lobe of the camshaft.

The follower assembly is provided with a cam roller having a rotation axis arranged perpendicularly to the longitudinal movement direction of the pumping plunger. The roller is contacted by the cam lobe(s) of the camshaft, so that the rotary movement of the camshaft can be transformed in a linear movement of the roller tappet and thus of the pumping plunger of the fuel unit pump, connected thereto. The fuel unit pump is fluidly connected to the fuel injectors, preferably by a fuel rail, to supply fuel in the engine cylinder.

In this configuration, a very high precision is required to assure that the roller tappet, and in particular the cam roller of the roller tappet, is correctly aligned with respect to the camshaft when the fuel unit pump is mounted in the internal combustion engine (preferably in the cylinder head or in the engine block of the internal combustion engine). In other words, it should be assured that the axis of rotation of the cam roller is exactly parallel to the rotation axis of the rotatable shaft, e.g. the rotation axis of the camshaft. As a result, the lateral surface of the cam roller can properly contact the lateral surface of the relevant cam lobe of the camshaft.

However, due to certain factor, such as machining errors and tolerances, it is difficult to satisfy the above mentioned conditions, so that misalignments may occur between the cam lobe and the cam roller. In order to avoid this condition, the cam roller has a so called "crowning" or "logarithmic" profile so that contact between the two elements is only punctual (the so called "edge effect"). While these profiles avoid punctual contact but also limit the maximum possible contact area between the two elements. As a result, higher stresses are generated on the cam roller. The cam roller must be dimensioned larger than otherwise required, resulting in additional complexity and cost for the cam roller. However, the size of the cam roller cannot be unlimited, so that a limit is imposed also to the fuel pressure handled by the fuel unit pump.

Furthermore, because of the problem caused by misalignments, machining tolerance of the fuel unit pump and of the portions of the internal combustion engine cooperating with the fuel unit pump should be very strict.

SUMMARY

In accordance with the present disclosure, a fuel unit pump is provided which reduces misalignments problems, while increasing the fuel injection pressure and/or flow capabilities. The fuel unit pump is further configured to reduce the manufacturing costs of the internal combustion engine.

According to an embodiment, a fuel unit pump for an internal combustion engine includes a fuel unit pump body, a pumping plunger and a roller tappet for contacting the cam lobe of a rotatable shaft (e.g. a camshaft) of the internal combustion engine. The roller tappet includes a roller tappet body, connected to the pumping plunger, and a cam roller rotatably mounted on a cam roller carrier and having a cam roller rotation axis. The cam roller carrier is coupled to the roller tappet body and is elastically deformable for aligning the cam roller with the cam lobe of the rotatable shaft. In particular, the cam roller carrier is configured to elastically deform to compensate misalignments between the cam lobe and the cam roller. In other words, the contact between the cam lobe of the rotatable shaft (e.g. the camshaft) and the cam roller causes an elastic deformation of the cam roller carrier. Misalignments between the cam lobe and the cam roller are small, so that the cam roller carrier is deformed towards the position of correct alignment between the two elements.

An advantage of the present solution is that the cam roller carrier can move with respect to the roller tappet body. As a result, the roller, mounted on the roller carrier, can be aligned with respect to the camshaft. In particular, the roller rotation axis can be tilted until it is parallel to the axis of rotation of the rotatable shaft. As a result, the correct coupling between the cam lobes of the camshaft and the roller of the follower assembly is achieved.

Moreover, it is possible to manufacture the internal combustion engine with wider tolerances. Possible misalignments caused by these tolerances are in fact compensated by the elastic deformation of the cam roller carrier with respect to the roller tappet body. As a result, in the present disclosure, the use of the fuel unit pump in an internal combustion engine makes the manufacture of the internal combustion engine easier and less costly.

In fact, the initial misalignment between the camshaft and the cam roller of the roller tappet is compensated by the elastic deformation of the cam roller carrier, which results in a movement of the cam roller. As a result, the stress applied on the cam roller is independent from such an initial misalignment. In fact, the cam roller contacts a cam lobe of the rotatable shaft (e.g. a camshaft), always in the aligned condition. Thus, the cam roller can be properly dimensioned, e.g. avoiding oversizing, or higher loads/pressure values can be effectively transmitted between the cam roller and the cam lobe.

According to an embodiment, the cam roller carrier is at least partially made of an elastic material, and the shape of the cam roller carrier is configured to provide a cross section having a moment of inertia allowing deformation of the cam roller carrier. In other words, the cam roller carrier is at least partially made of an elastic material and it can have a shape that allows deformations thanks also to the moment of inertia of the cross section. According to an embodiment, the cross section is substantially arc-shaped. According to an embodiment, the cam roller carrier is at least partially made of a material having elastic modulus less than the elastic modulus of the material of the roller tappet body. The cam roller carrier according to one or more of the preceding aspects can thus be provided with the required elasticity to provide for the required elastic deformation.

According to an embodiment, the roller tappet body is provided with a body axis and the cam roller carrier is elastically deformable to tilt the cam roller rotation axis at least along a rotation plane including the cam roller rotation axis and being parallel to the above mentioned body axis. High stresses on the cam roller are caused by misalignments between the axis of the camshaft and the axis of the cam roller. In an embodiment, the cam roller carrier is deformable in the above mentioned plane to quickly and effectively compensate such a misalignment.

According to an embodiment, the cam roller carrier is at least partially made of spring steel. As known, "spring steel" is a class of steels providing a low elastic modulus and a high yield strength, and which are commonly used in the production of springs. Suitable example of spring steels for embodiments of the present disclosure are CrSiV steels.

According to an embodiment, the cam roller carrier is materially joined (i.e., welded or brazed) or mechanically interlocked to the roller tappet body. This allows quick and effective coupling of the two elements.

According to an embodiment, the roller carrier includes two portions arranged at opposite sides of the roller. The position of the cam roller can thus be properly guided by these portions during the elastic deformation of the cam roller carrier. The two portions can be part of a one piece cam roller carrier (e.g. the above mentioned cam roller carrier having an arc-shaped cross section), or they can be part of independent (i.e. separate) elements.

According to an embodiment, the two above mentioned portions are coupled to opposite sides of a cam roller pin. The cam roller is coupled to the cam roller pin. Mounting of the cam roller is thus simple and reliable.

According to an embodiment, the two portions are arranged on at least one flange of the cam roller carrier. Typically, the two portions are arranged on two flanges of the cam roller carrier (i.e. one portion on a first flange and a second portion on a second flange). The flange is an element having reduced thickness, which thus can be easily elastically deformed (in particular bent) to provide for the required movement of the cam roller, i.e. the required movement to align the cam roller to the camshaft.

According to an embodiment the cam roller carrier includes a flat elongated portion and two flanges at opposite sides of the flat elongated portion. This provide for a simple and cost-effective configuration of the cam roller carrier. Advantages of the flanges have been already discussed.

According to an embodiment, the cam roller is provided with a flat lateral surface. This is a simple shape to produce. Also it provides for a great area of contact between the cam roller and the camshaft (i.e. a cam lobe of the camshaft). Forces between the two elements are thus transmitted through a great area, reducing stresses on the elements.

A further embodiment of the present disclosure provides for an internal combustion engine including a fuel unit pump according to one or more of the preceding aspects, a rotatable shaft (e.g. a camshaft) provided with at least one cam lobe and rotatable around a rotation axis. The cam roller of the fuel unit pump is coupled to the cam lobe to transmit the rotary movement of the rotatable shaft to the fuel unit pump, to actuate it.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description. Exemplary embodiments will now be described with reference to the enclosed drawings without intent to limit application and uses.

Figure 1:
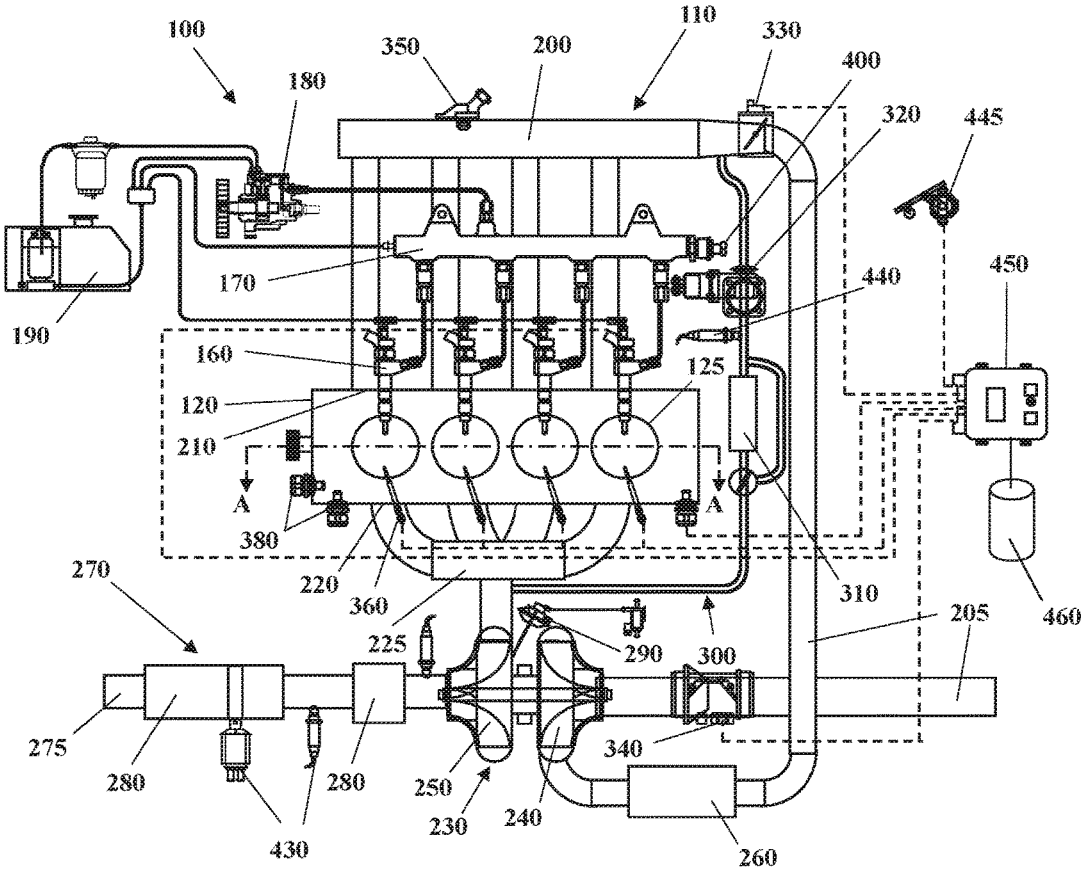
FIG. 1 shows an embodiment of an automotive system including an internal combustion engine in which the fuel unit pump may be used.
Figure 2:
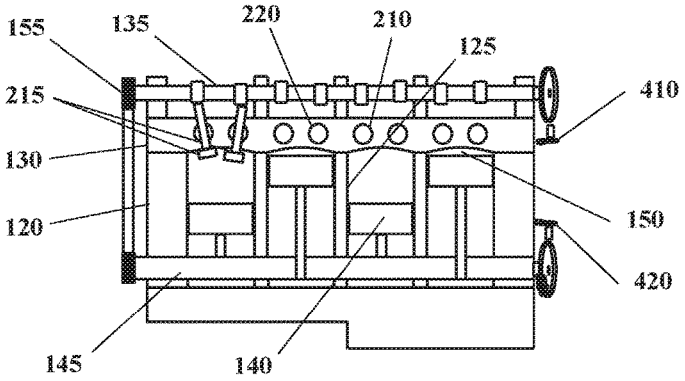
FIG. 2 is a cross-section according to the plane A-A of an internal combustion engine belonging to the automotive system of FIG. 1.

Some embodiments may include an automotive system 100, as shown in FIGS. 1 and 2, that includes an internal combustion engine (ICE) 110 having an engine block 120 defining at least one cylinder 125 having a piston 140 coupled to rotate a crankshaft 145. A cylinder head 130 cooperates with the piston 140 to define a combustion chamber 150. A fuel and air mixture (not shown) is disposed in the combustion chamber 150 and ignited, resulting in hot expanding exhaust gasses causing reciprocal movement of the piston 140. The fuel is provided by at least one fuel injector 160 and the air through at least one intake port 210. The fuel is provided at high pressure to the fuel injector 160 from a fuel rail 170 in fluid communication with a high pressure fuel unit pump 180 that increase the pressure of the fuel received from a fuel source 190. Each of the cylinders 125 has at least two valves 15, actuated by the camshaft 135 rotating in time with the crankshaft 145. The valves 215 selectively allow air into the combustion chamber 150 from the port 210 and alternately allow exhaust gases to exit through a port 220. In some examples, a cam phaser 155 may selectively vary the timing between the camshaft 135 and the crankshaft 145.

The air may be distributed to the air intake port(s) 210 through an intake manifold 200. An air intake duct 205 may provide air from the ambient environment to the intake manifold 200. In other embodiments, a throttle body 330 may be provided to regulate the flow of air into the manifold 200. In still other embodiments, a forced air system such as a turbocharger 230, having a compressor 240 rotationally coupled to a turbine 250, may be provided. Rotation of the compressor 240 increases the pressure and temperature of the air in the duct 205 and manifold 200. An intercooler 260 disposed in the duct 205 may reduce the temperature of the air. The turbine 250 rotates by receiving exhaust gases from an exhaust manifold 225 that directs exhaust gases from the exhaust ports 220 and through a series of vanes prior to expansion through the turbine 250. The exhaust gases exit the turbine 250 and are directed into an exhaust system 270. This example shows a variable geometry turbine (VGT) with a VGT actuator 290 arranged to move the vanes to alter the flow of the exhaust gases through the turbine 250. In other embodiments, the turbocharger 230 may be fixed geometry and/or include a waste gate.

The exhaust system 270 may include an exhaust pipe 275 having one or more exhaust aftertreatment devices 280. The aftertreatment devices may be any device configured to change the composition of the exhaust gases. Some examples of aftertreatment devices 280 include, but are not limited to, catalytic converters (two and three way), oxidation catalysts, lean NOx traps, hydrocarbon adsorbers, selective catalytic reduction (SCR) systems, and particulate filters. Other embodiments may include an exhaust gas recirculation (EGR) system 300 coupled between the exhaust manifold 225 and the intake manifold 200. The EGR system 300 may include an EGR cooler 310 to reduce the temperature of the exhaust gases in the EGR system 300. An EGR valve 320 regulates a flow of exhaust gases in the EGR system 300.

The automotive system 100 may further include an electronic control unit (ECU) 450 in communication with one or more sensors and/or devices associated with the ICE 110. The ECU 450 may receive input signals from various sensors configured to generate the signals in proportion to various physical parameters associated with the ICE 110. The sensors include, but are not limited to, a mass airflow and temperature sensor 340, a manifold pressure and temperature sensor 350, a combustion pressure sensor 360, coolant and oil temperature and level sensors 380, a fuel rail pressure sensor 400, a cam position sensor 410, a crank position sensor 420, exhaust pressure and temperature sensors 430, an EGR temperature sensor 440, and an accelerator pedal position sensor 445. Furthermore, the ECU 450 may generate output signals to various control devices that are arranged to control the operation of the ICE 110, including, but not limited to, the fuel unit pump 180, fuel injectors 160, the throttle body 330, the EGR Valve 320, the VGT actuator 290, and the cam phaser 155. Note, dashed lines are used to indicate communication between the ECU 450 and the various sensors and devices, but some are omitted for clarity.

Turning now to the ECU 450, this apparatus may include a digital central processing unit (CPU) in communication with a memory system 460, or data carrier, and an interface bus. The CPU is configured to execute instructions stored as a program in the memory system, and send and receive signals to/from the interface bus. The memory system 460 may include various storage types including optical storage, magnetic storage, solid state storage, and other non-volatile memory. The interface bus may be configured to send, receive, and modulate analog and/or digital signals to/from the various sensors and control devices.

Instead of an ECU 450, the automotive system 100 may have a different type of processor to provide the electronic logic, e.g. an embedded controller, an onboard computer, or any processing module that might be deployed in the vehicle.

Figure 3:
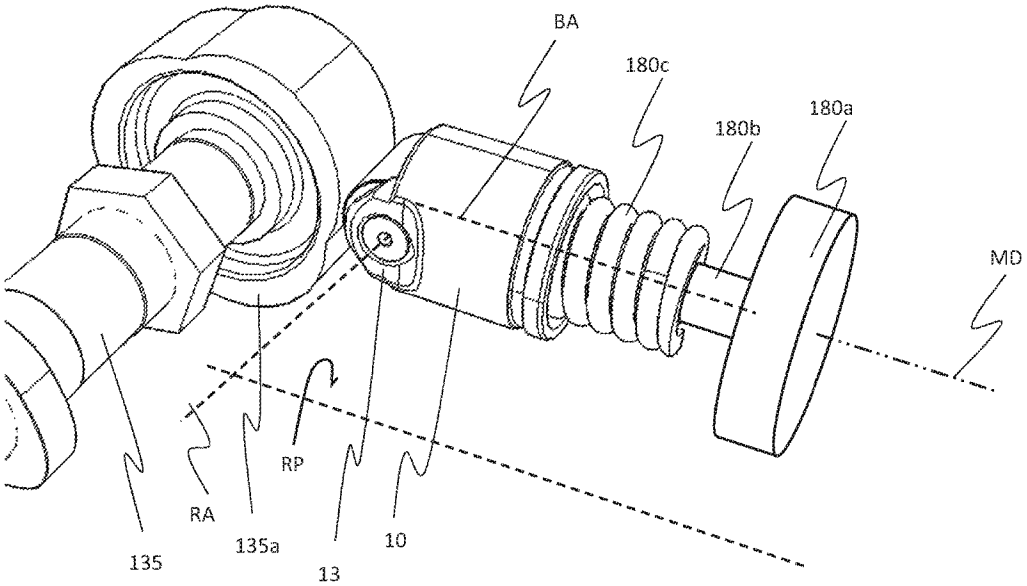
FIG. 3 is a perspective view of a fuel unit pump of an embodiment of the present disclosure coupled to a camshaft of an internal combustion engine.
Figure 4:
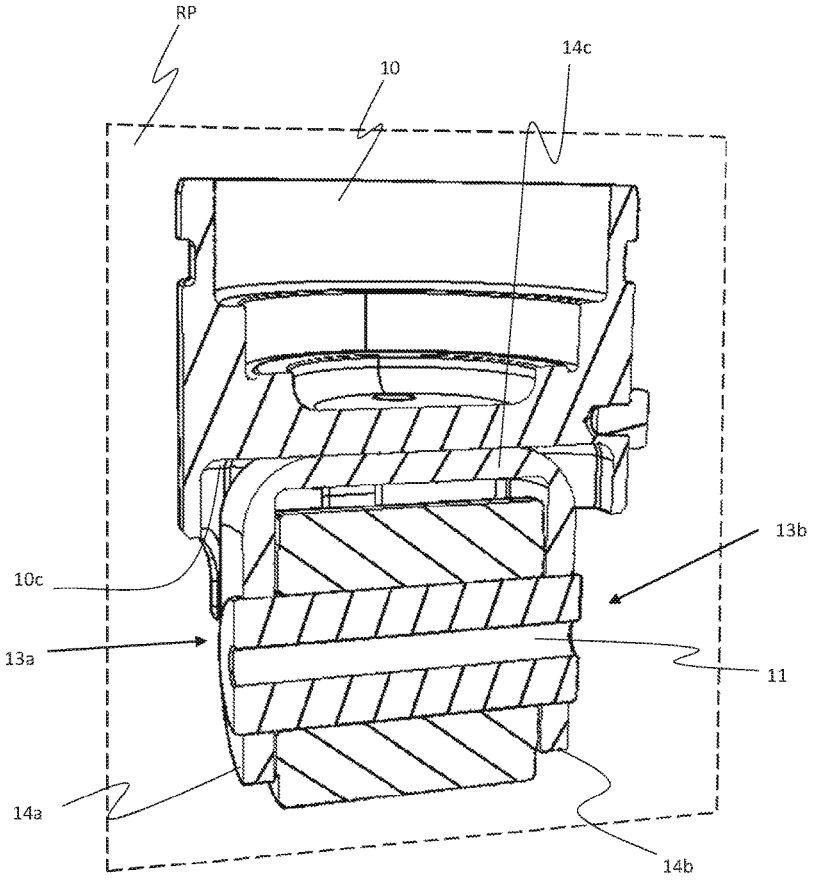
FIG. 4 is a sectional view of a roller tappet according to an embodiment of the present disclosure.
Figure 5:
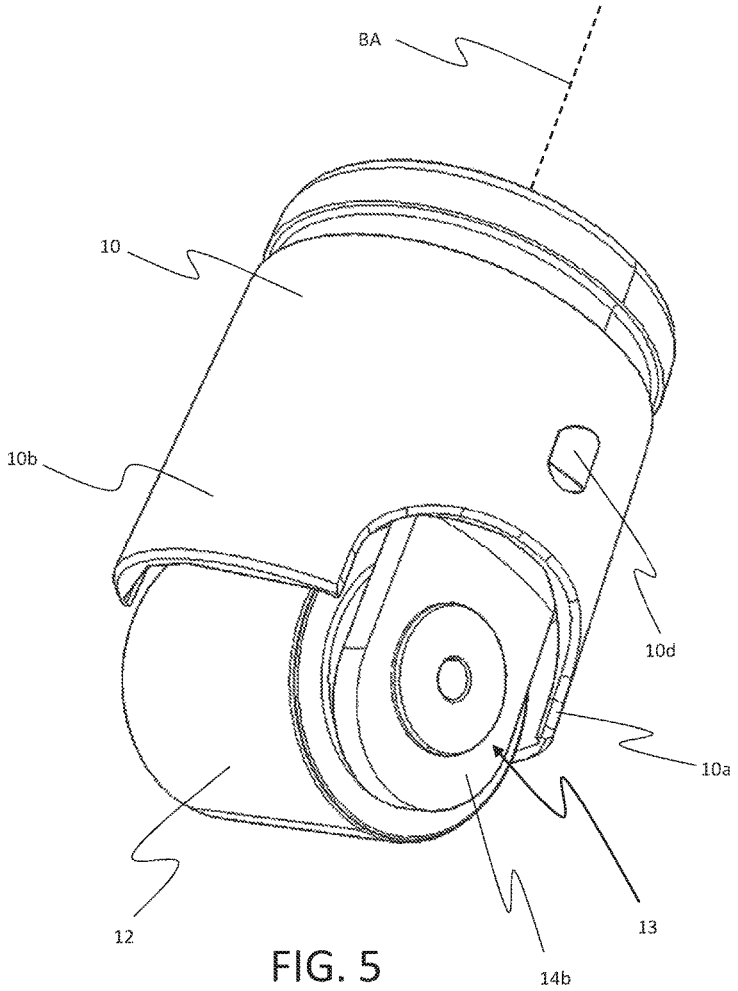
FIG. 5 is a perspective view of the roller tappet of FIG. 4.

According to an embodiment of the present disclosure, as shown in FIGS. 3-5, the fuel unit pump 180 includes a fuel unit pump body 180*a* and a pumping plunger 180*b*. The pumping plunger 180*b* is arranged at least in part within the fuel unit pump body 180*a* and movable along a longitudinal movement direction MD. More in detail, the pumping plunger 180*b* is movable with respect to fuel unit pump body 180*a*, preferably inside a chamber provided inside the fuel unit pump body 180*a*.

The longitudinal movement direction MD of the pumping plunger 180*b* preferably corresponds to the longitudinal axis of the pumping plunger 180*b*. The pumping plunger 180*b* is movable along a longitudinal movement direction MD, for drawing fuel from the fuel source and for pressurizing it before the delivery outside the fuel unit pump, for example to a fuel injector 160.

In fact, according to a possible embodiment, in the internal combustion engine 110 in which the fuel unit pump 180 can be used, the fuel unit pump 180 is connected to a fuel source 190, from which the fuel is provided. The fuel unit pump 180 is connected to one or more fuel injectors 160 (injector nozzle), preferably by a fuel rail 170. For this purpose the fuel unit pump 180 is provided with a fuel inlet opening and a fuel outlet opening formed in the body 180*a* thereof, and fluidically connected to the chamber provided therein, inside which the pumping plunger 180*b* is moveable.

More in detail, the fuel is supplied to the fuel injector 160 from the fuel unit pump 180 due to a pumping movement of the pumping plunger 180*b* along the longitudinal movement direction MD. In fact, the pumping plunger 180*b* is movable along longitudinal movement direction MD between a non-operative position (preferably corresponding to a non-pumping position), in which it is extracted from the body of the fuel unit pump, and in particular from a chamber provided therein, and an operative position (preferably corresponding to a pumping position) in which it is moved inside the fuel unit pump body.

The fuel unit pump 180 includes a biasing element 180*c*, for example including at least one spring or other elastic element, can be provided to maintain the pumping plunger 180*b* in the non-operative position. The fuel unit pump 180 also includes a roller tappet RT including a roller tappet body 10, connected to the pumping plunger 180*b*, and a cam roller 12 rotatably mounted on a cam roller carrier 13 and having a cam roller rotation axis RA.

According to an embodiment, shown in the figures, the roller tappet body 10 is provided with a body axis BA. The body axis BA is typically parallel to (and preferably coincides with) the movement direction MD of the pumping plunger 180*b*. Typically the roller tappet body 10 has a substantially cylindrical shape. In such an embodiment, the body axis BA is the longitudinal axis of the cylinder. However, different shapes of the roller tappet body 10 can be provided. Cylindrical shape is however preferred, as the roller tappet body 10 is typically installed in the cylinder head 130, and in particular in a hole (not shown) of the cylinder head 130.

The roller tappet body 10 can be provided with one or more protrusion 10*d* to correctly orientate the roller tappet body 10 within the relevant seat of the cylinder head 130. Typically, the protrusion 10*d* protrudes from the lateral surface of the roller tappet body 10. In particular, the protrusion 10*d* can be part of the roller tappet body 10. In other embodiments, the protrusion 10*d* can be part of an element contained within the roller tappet body 10, and protruding from the latter through an opening. As a result, the protrusion 10*d* can be used also to correctly orientate such an element with respect to the roller tappet body itself.

The roller tappet RT is movable with the pumping plunger 180*b* in the longitudinal movement direction MD. As for example shown in the figures, the longitudinal movement direction MD is a movement along a straight line, preferably a reciprocating movement along the longitudinal movement direction MD.

The pumping plunger 180*b* of the fuel unit pump 180, connected to the roller tappet RT, is actuated along the longitudinal movement direction MD to reach an operative position, by means of the camshaft 135, and in particular by at least one cam lobe 135*a* of the camshaft. More in detail, the cam roller 12 is mounted on the cam roller carrier 13 and engages the cam lobe(s) 135*a* of the camshaft in order to actuate the fuel unit pump 180. The cam roller carrier 13 is mounted on the roller tappet body 10 and is elastically deformable, so as to allow a movement of the cam roller 12 with respect to the roller tappet body 10. In other words, as better discussed later, the elastic deformation of the cam roller carrier 13 causes the movement of cam roller 12, which allows to align the latter with the camshaft 135, and in particular with the cam lobe 135*a* to which the cam roller 12 is engaged.

According to an embodiment, the elastic deformation of the cam roller carrier 13 causes the tilting of the cam roller rotation axis RA in the rotation plane RP. The rotation plane RP is a plane including the cam roller rotation axis RA and being parallel to the body axis BA of the roller tappet body 10. Typically both the cam roller rotation axis RA and body axis BA lie on the rotation plane RP. The rotation plane RP is the plane of the section of FIG. 4.

As mentioned, the roller tappet body 10 has a cylindrical section. In these embodiment, the rotation plane RP is preferably a including the cam roller rotation axis RA and splitting the roller tappet body 10 in two substantially equal halves. According to an embodiment, the cam roller carrier 13 includes two portions 13*a*, 13*b* arranged at opposite sides of the cam roller 12. The two portions 13*a*, 13*b* allows rotatable coupling of the cam roller 12 to the cam roller carrier 13. In particular, in the shown embodiment, the cam roller 12 is coupled to a pin 11. The pin 11 is inserted through the two portions 13*a*, 13*b* of the cam roller carrier 13.

Various arrangements are possible. In the shown embodiment, the pin 11 is fixed to the cam roller carrier 13, and the cam roller is rotatable around the pin 11, e.g. by means of bearings, not shown. Otherwise, the pin 11 can be rotatable with respect to the cam roller carrier 13, while the pin 11 and the cam roller 12 are fixed one to the other. Furthermore, in a further embodiment, the pin 11 can be rotatable with respect to the cam roller carrier 13, and the cam roller 12 can be in turn rotatable with respect to the pin 11. Also, in different embodiments, the pin 11 can be omitted. As an example, the roller carrier may be provided with cylindrical protrusions, and the cam roller may be provided with cylindrical seats for these protrusions, or vice versa.

In general, the cam roller 12 is rotatably mounted on the cam roller carrier 13, typically to the two portions 13*a*, 13*b* of the cam roller carrier 13, so that the cam roller 12 can be rotated around the cam roller rotation axis RA. In the shown embodiment, the two portions 13*a*, 13*b* are arranged on two opposite flanges 14*a*, 14*b* of the cam roller carrier 13. In particular, in the shown embodiment, the cam roller carrier 13 includes a flat elongated portion 14*c* and two flanges 14*a*, 14*b* at opposite sides of the flat elongated portion 14*c*. More in detail, the shown cam roller carrier 13 is made from a flat elongated lamina, which is bent at opposite ends in order to realize the two flanges 14*a*, 14*b*.

Different embodiments are possible. As an example, the shown cam roller carrier 13 is in one piece, i.e. the two flanges 14*a*, 14*b* are part of the same element. In different embodiments, not shown, the cam roller carrier can be composed of a plurality of elements. As an example, flanges 14*a* and 14*b* can be part of different elements, e.g. of two L-shaped elements.

Furthermore, in the shown embodiments, the roller tappet body 10 is provided with two tabs 10*a*, 10*b*, arranged at the lateral sides of the cam roller 12. In different embodiments the tabs 10*a*, 10*b* can be absent. The cam roller carrier 13 can thus be provided with a single flange, surrounding at least partially the cam roller 12. Such a single flange can be thus provided with both the portions 13*a* and 13*b* above disclosed. As an example, the cam roller carrier 13 can be shaped as a dome, or a cup, so that the "flange" defines the lateral surface of the cam roller carrier 13. The cam roller 12 can be coupled to the internal lateral surface (i.e. internal surface of the flange) of such a dome/cup.

In general, the cam roller carrier 13 is typically provided with two portions 13*a*, 13*b* for coupling the cam roller 12 to the cam roller carrier 13. The cam roller carrier 13 can be coupled to the roller tappet body 10 in different ways. In the shown embodiment, the cam roller carrier 13 is welded to the roller tappet body 10. In more detail, the flat elongated portion 14*c* is welded to a surface 10*c* of the roller tappet body 10, which is typically a surface arranged substantially parallel to the cam roller rotation axis RA. Alternatively, the flat elongated portion 14*c* can be brazed to a surface 10*c* of the roller tappet body.

In general, the cam roller carrier 13 is coupled to the roller tappet body 10 so that movements of the latter along movement direction MD are transmitted also to the cam roller carrier 13, too. However, such a coupling between the cam roller carrier 13 and the roller tappet body 10 is configured to allow the elastic deformation of the cam roller carrier 13. Typically, the elastic deformation of the cam roller carrier 13 occurs in the portions of the latter that are distant from the coupling between the cam roller carrier 13 and the roller tappet body 10.

In the shown example, the elastic deformation of the cam roller carrier 13 occurs mainly in the flanges 14*a* and 14*b*, which are not welded or brazed to the roller tappet body 10. In particular, the flanges 14*a* and 14*b* can be elastically bent with respect to the cam roller body 10. The elastic deformation of the cam roller carrier 13 is typically due to the dimension and/or the choice of the material(s) composing the cam roller carrier. As an example, the thickness of predetermined portions (e.g. the flanges 14*a*, 14*b* of the shown embodiment) can be reduced, in order to allow deformation of such portions. Furthermore, a material having elastic properties can be chosen for at least part of the cam roller carrier 13. Such a material should be "elastic" so as to allow deformation of the cam roller carrier 13, but at the same time it should be able to withstand the forces transmitted between the camshaft 135 and the cam roller 12.

In other words, the material of the cam roller carrier 13 should be chosen so that the latter can be elastically deformed by the above mentioned forces, but e.g. it should not be plastically deformed, or it should not break under the action of these forces. A suitable material for the cam roller carrier 13 of embodiments of the present disclosure is known under the name of "spring steel." As above mentioned, "spring steel" (so called because they are used for the production of springs) refers to particular kinds of known steels that have typically "low" elastic modulus (i.e. "low" if compared to other steels or metals), and high yield strength.

In general, the cam roller carrier 13 is preferably at least partially made of a material having elastic modulus less than the elastic modulus of the material of the roller tappet body 10. As mentioned, the deformation of the cam roller carrier 13 preferably allows tilting of the cam roller rotation axis RA at least in a rotation plane RP (i.e. around an axis perpendicular to such a plane). Anyway, other kinds of movements can be allowed to the cam roller 12, e.g. a three-dimensional rotation, i.e. a movement not contained in a single plane.

In general, the cam roller carrier 13 is elastically deformable so as to allow to correctly position the cam roller 12 against a cam lobe 135*a* of the camshaft, i.e. to align the first with the latter. Preferably, at least part of the lateral surface of the cam roller 12 is flat. Maximum contact area between the cam roller 12 and the cam lobe 135*a* is thus assured, and problems (e.g. the above mentioned "edge effect") relating possible misalignments between the two elements are avoided thanks to the elastic deformation of the cam roller carrier 13.

During operation of the internal combustion engine 110, the camshaft 135 rotates around a camshaft rotation axis CA. It has to be noted that preferably the camshaft rotation axis corresponds to the extension (longitudinal) axis of the camshaft. The cam roller 12 is coupled to the camshaft 135 and in particular with the cam lobe(s) 135*a* of the camshaft 135. As known in the art, the fuel unit pump 180 is arranged on the internal combustion engine 110, preferably in correspondence of the cylinder head 130 (for example shown in FIG. 1 and in FIG. 5). The roller tappet RT and in particular the cam roller 12, the cam roller carrier 13 and the roller tappet body 10 are arranged in a seat, e.g. a hole, of the internal combustion engine 110, and in particular of the cylinder head 130, inside which these elements are movable (as for example schematically shown in FIG. 5).

As mentioned above, the roller tappet RT follows the movement of at least one cam lobe 135*a* of a camshaft 135 of the internal combustion engine 110. The coupling between the roller 12 and the camshaft 135 causes the deformation of the cam roller carrier 13 in the case the cam roller 12 and the camshaft 135 (in particular the cam lobe 135*a*) is not aligned. More in detail, the roller carrier 13 is elastically deformed with respect to the roller tappet body 10 if the two cam roller 12 and the camshaft 135 are not aligned (i.e., typically when the camshaft axis CA is not parallel with the cam roller rotation axis RA).

By doing so, the rotation axis RA of the roller 12 is tilted, typically in the rotation plane RP, so as to be parallel to the camshaft rotation axis CA. This allows an efficient transmission of the rotary movement of the camshaft to the pumping plunger 180*b* by means of the roller tappet RT of the fuel unit pump 180, without increasing contact stresses between the roller 12 and the cam lobe 135*a* of the camshaft 135. Moreover, the rotation of the camshaft 135, and thus of the cam lobe(s) 135*a*, causes the reciprocation of the roller tappet WI and thus of the pumping plunger 180*b* along the longitudinal movement direction MD. As before explained, this alternate movement allows pumping of fuel to the injectors 160.

While at least one exemplary embodiment has been presented in the foregoing detailed description, it should be appreciated that a vast number of variations exist, it should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A fuel unit pump for an internal combustion engine having a rotatable shaft with a cam lobe, the fuel unit pump comprising:

a fuel unit pump body;

a pumping plunger; and a roller tappet configured to contact the cam lobe and having a roller tappet body connected to said pumping plunger, and a cam roller rotatably mounted on a cam roller carrier and defining a cam roller rotation axis, wherein said cam roller carrier is coupled to said roller tappet body and is elastically deformable for aligning said cam roller with said cam lobe, wherein said cam roller carrier comprises a material having an elastic modulus that is less than an elastic modulus of a material of the roller tappet body.

2. The fuel unit pump according to claim 1, wherein said cam roller carrier comprises a cross section of the cam roller carrier has a moment of inertia enabling deformation of the cam roller carrier for aligning said cam roller with said cam lobe.

3. The fuel unit pump according to claim 2, wherein said cross section comprises an arc-shaped cross section.

4. The fuel unit pump according to claim 1, wherein said roller tappet body defines a body axis and said cam roller carrier is elastically deformable to tilt said cam roller rotation axis at least in a rotation plane including the rotation axis and parallel to body axis.

5. A fuel unit pump for an internal combustion engine having a rotatable shaft with a cam lobe, the fuel unit pump comprising:

a fuel unit pump body;

a pumping plunger; and a roller tappet configured to contact the cam lobe and having a roller tappet body connected to said pumping plunger, and a cam roller rotatably mounted on a cam roller carrier and defining a cam roller rotation axis, wherein said cam roller carrier is coupled to said roller tappet body and is elastically deformable for aligning said cam roller with said cam lobe, wherein said cam roller carrier is at least partially made of spring steel.

6. The fuel unit pump according to claim 1, wherein said cam roller carrier is materially joined to said roller tappet body.

7. The fuel unit pump according to claim 1, wherein said cam roller carrier comprises a first portion and a second portion arranged on an opposite side of said cam roller from the first portion.

8. The fuel unit pump according to claim 7, wherein said first and second portions are coupled to opposite sides of a cam roller pin, wherein the cam roller is coupled to said cam roller pin.

9. The fuel unit pump according to claim 7, wherein said first and second portions are arranged on at least one flange of said cam roller carrier.

10. The fuel unit pump according to claim 1, wherein said cam roller carrier comprises a flat elongated portion and two flanges at opposite sides of said flat elongated portion.

11. The fuel unit pump according to claim 1, wherein said cam roller comprises a flat lateral surface.

* * * * *